US006406308B1

(12) United States Patent
Wang

(10) Patent No.: US 6,406,308 B1
(45) Date of Patent: Jun. 18, 2002

(54) SAFETY DEVICE AND DUST PROTECTION FOR A POWER STRIP

(76) Inventor: Ming-Shan Wang, No. 5, Alley 4, Lane 108, Tung Hsing St., Taipei City (TW)

( * ) Notice: Subject to any disclaimer, the term of this patent is extended or adjusted under 35 U.S.C. 154(b) by 0 days.

(21) Appl. No.: 09/946,357

(22) Filed: Sep. 6, 2001

(51) Int. Cl.[7] ..... H01R 13/44
(52) U.S. Cl. ..... 439/145; 439/652
(58) Field of Search ..... 439/145, 491, 439/139, 136, 134, 135, 138, 140, 149, 652

(56) References Cited

U.S. PATENT DOCUMENTS 6,283,787 B1 * 9/2001 Chou ..... 439/488

* cited by examiner

*Primary Examiner*—Tho D. Ta
*Assistant Examiner*—Phuongchi Nguyen
(74) *Attorney, Agent, or Firm*—Rosenberg, Klein & Lee

(57) ABSTRACT

The present invention relates to a safety device and dust protection for a power strip which mainly includes a housing on which each outlet has two opposing parallel side frames each of which includes a slide rail. A hot, a neutral and a ground slots are disposed between both side frames on the housing. Also, a covering piece includes three slots corresponding to the hot, neutral and ground slots. The covering piece is fitted between both side frames in such a way that a complete surface is formed. The covering piece can be shifted for a certain distance to cover all of the electric slots. When the covering piece and both side frames form a complete surface of an outlet, all of the electric slots are free in a use state. To the contrary, the electric slots are covered in a closed state.

1 Claim, 12 Drawing Sheets

SAFETY DEVICE AND DUST PROTECTION FOR A POWER STRIP

BACKGROUND OF THE INVENTION

1. Field of the Invention

The present invention relates to a safety device and dust protection for a power strip, and more particularly, to a power strip by which the safety is ensured and which can be easily used.

2. Description of the Prior Art

A conventional power strip, as shown in FIG. 1, includes an extension cord to lead the power supply to a farther position so that it is often arranged at a place convenient for the plugs. Therefore, the children can easily touch the electric outlets (B) of the power strip (A). In order to avoid the danger caused, a cover (C) is placed on each of the outlet (B).

However, this solution is very inconvenient. In using the outlet, the cover (C) has to be dismantled while the dismantled cover (C) has to be placed somewhere for use in the next time. However, the cover (C) is a small component. In use, it's often not found or it has to be bought again. Besides, the operator often forgets to engage the cover (C) in place so that the electric danger is existing. Thus, this covering method to place the cover (C) upon the electric outlets (B) is inconvenient.

Accordingly, in order to resolve the aforementioned problem, the inside of the power strip (A) is fitted with a safety device in such a way that the electric outlets (B) are not directly connected with the conductive pieces (not shown) inside. Before use, the conductive pieces and the electric outlets (B) are in connection by means of pushing or turning a push bar, an inserting pin, spring, etc. These have been disclosed by the TW 360443, 403247, 361714, 331986, 323852, 296125, 286831, 196026, 190251, 356969, etc.

However, the above-mentioned method will change the original position or structure of the conductive piece. Therefore, it will have an adverse influence upon the electrical connection, or even the safety is endangered. Besides, the inconvenience in assembly must be increased when the power strip (A) is provided with safety structure. Furthermore, the dimensions of the power strip (A) will be changed or the volume is enlarged. Accordingly, it's not an perfect design.

Another commercially available power strip (D), as shown in FIGS. 2 and 3, includes a lateral groove (d2) interposed between the positive and negative slots (d1). The lateral groove (d2) is provided with a movable cover (d3). The electric slots (d1) is in open or closed state by moving the cover (d3) rightward or leftward. However, this configuration has two disadvantages. One is that the cover (d3) can only cover the positive and negative slots (d1) without the ground slot (d4). When the children insert a metal piece into the ground slot (d4), their safety is also endangered. Besides, the dust can enter through the ground slot (d4) so that the dustproof effect is lost. Secondly, the cover (d3) of the upper outlet is rightward shifted to show an open state while the cover (d3) of the lower outlet is leftward shifted to show the closed state. However, the open or closed states are really difficult to be identified with eyes, thereby causing the inconvenience in use.

FIG. 4 shows a further power strip (E) on which a covering piece (e3) is placed to cover the three electric slots completely. From the illustration in FIG. 4, the open or closed states are also difficult to be identified with eyes, thereby causing the inconvenience in use.

FIGS. 5 and 6 illustrate the enlarged views of an outlet of FIG. 4. The three electric slots (e1) are contained in a lateral groove (e2) on which a covering piece (e3) is placed. Thus, the covering piece (e3) has to be moved from a point to b point for a distance (W) to cover the slots (e1) completely. When the covering piece (e3) is moved rightward (as shown in FIG. 6), three electric slots (e1) are completely covered so that it makes progress in comparison with the FIGS. 2 and 3. However, the covering piece (e3) can't be smoothly engaged into the lateral groove (e2). The engaging projecting portions at both sides of the covering piece (e3) can't be too large to hinder the engagement. When the engaged covering piece (e3) is forced in the arrow direction (F), then it can be smoothly moved to the right side as shown in FIG. 6. When the direction of the exerted force is deviated, as shown by the arrows (F1) or (F2), the covering piece (e3) is easily deviated or turned to be separate from the lateral groove (e2).

SUMMARY OF THE INVENTION

It is a primary object of the present invention to provide a safety device and dust protection for a power strip without changing the original configuration and position of the conductive elements inside the outlet so that the electric connection, the structure and the volume won't be influenced while safety and dustproof effects are ensured.

It is another object of the present invention to provide a safety device and dust protection for a power strip which is always in connection with the outlet so that the convenience in use are achieved.

It is a further object of the present invention to provide a safety device and dust protection for a power strip which is personalized and meets the needs for use by vision.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
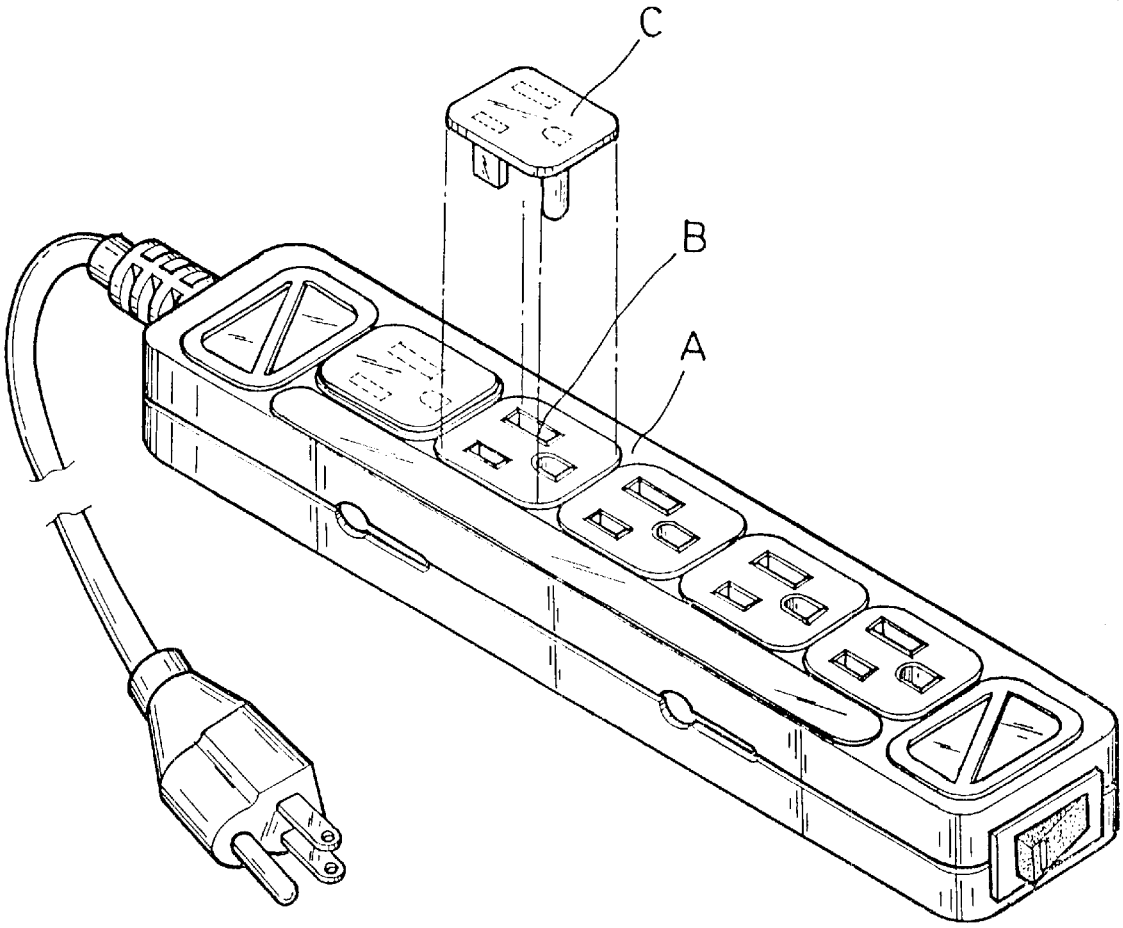
FIG. 1 PRIOR ART
FIG. 1 is a perspective view of a conventional power strip.
Figure 2:
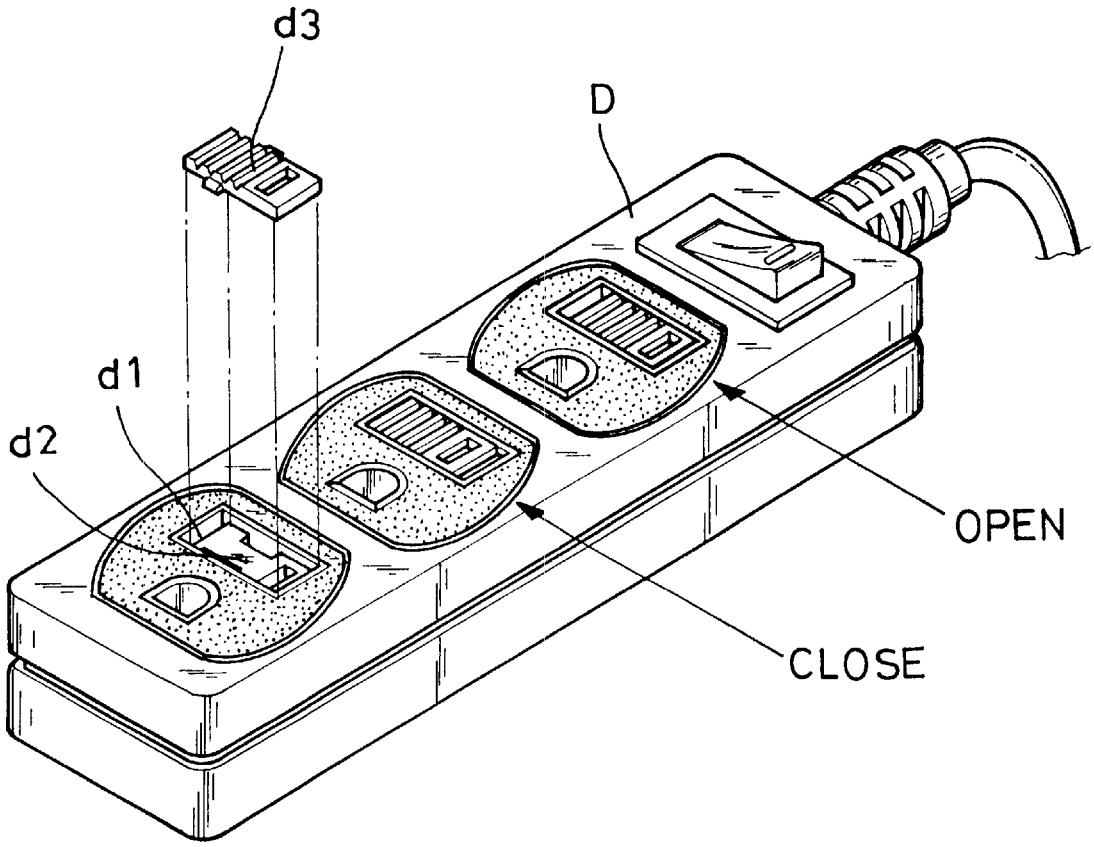
FIG. 2 PRIOR ART
FIG. 2 is a perspective view of another conventional power strip.
Figure 3:
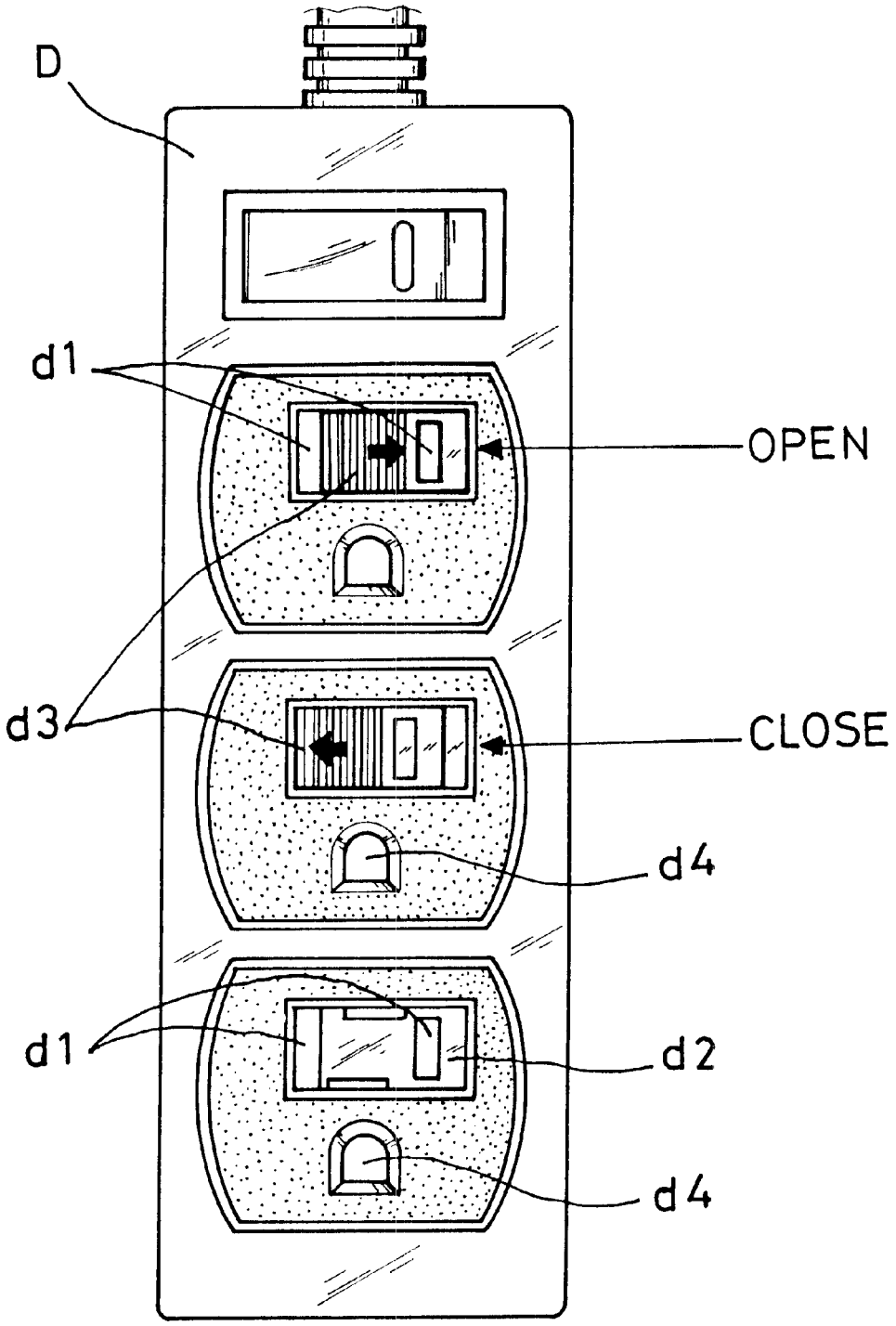
FIG. 3 PRIOR ART
FIG. 3 is a top view of FIG. 2.
Figure 4:
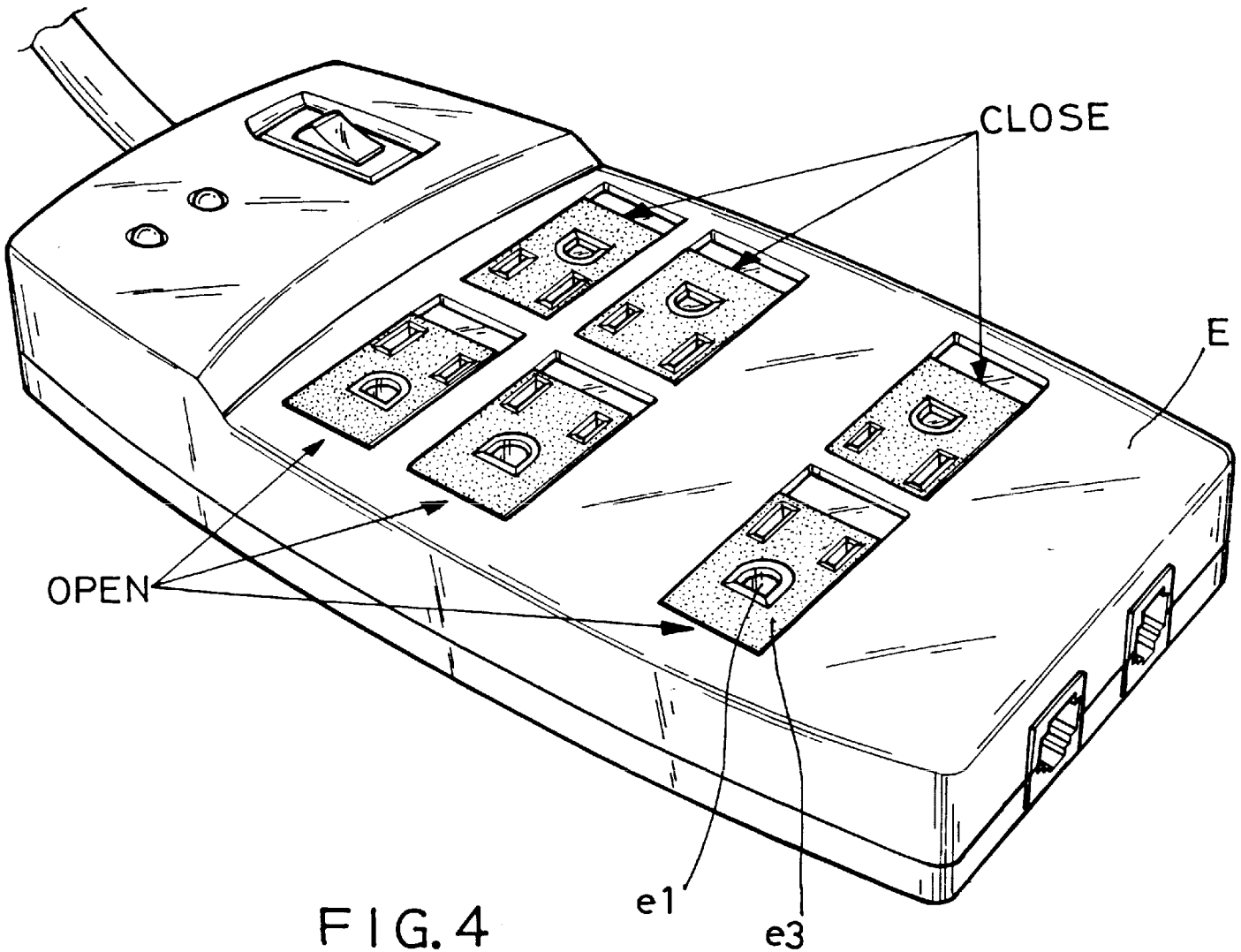
FIG. 4 PRIOR ART
FIG. 4 is a perspective view of a further conventional power strip.
Figure 5:
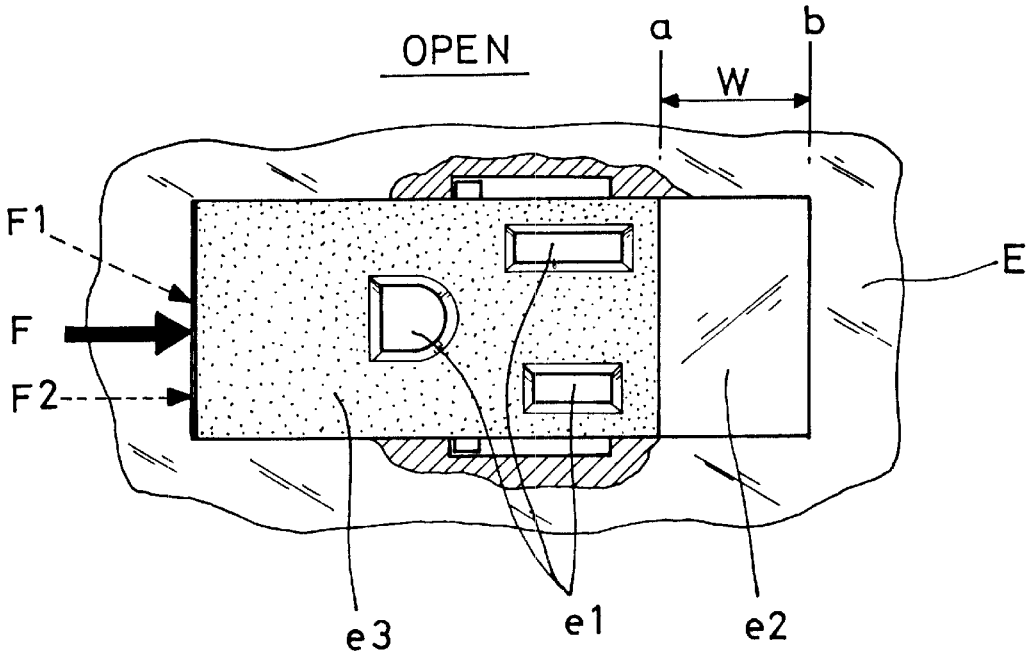
FIG.5 PRIOR ART
FIG. 5 is an enlarged view of an outlet in FIG. 4, showing the opening state.
Figure 6:
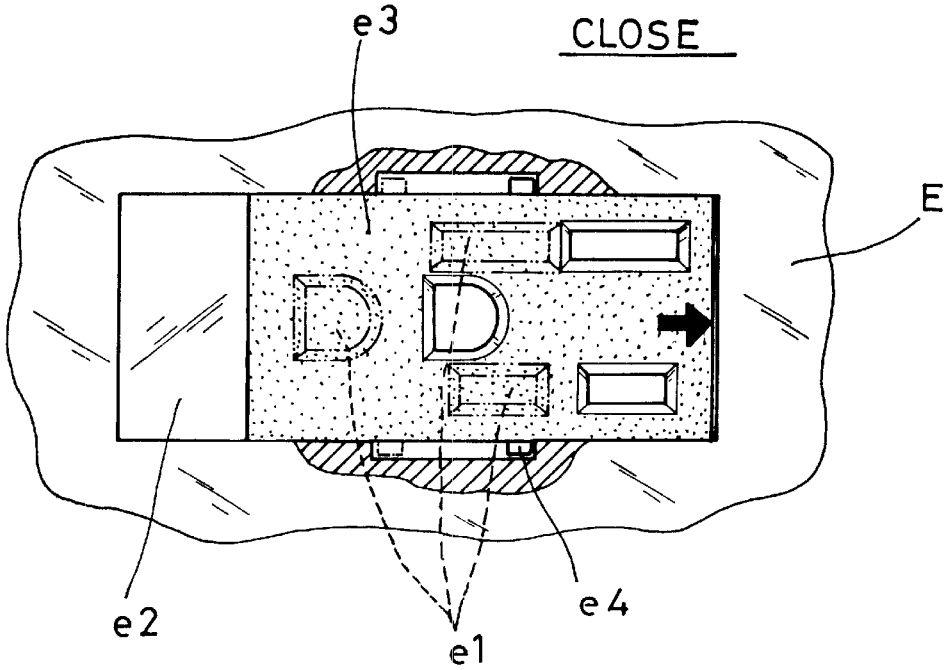
FIG.6 PRIOR ART
FIG. 6 is an enlarged view of an outlet in FIG. 4, showing the closing state.
Figure 7:
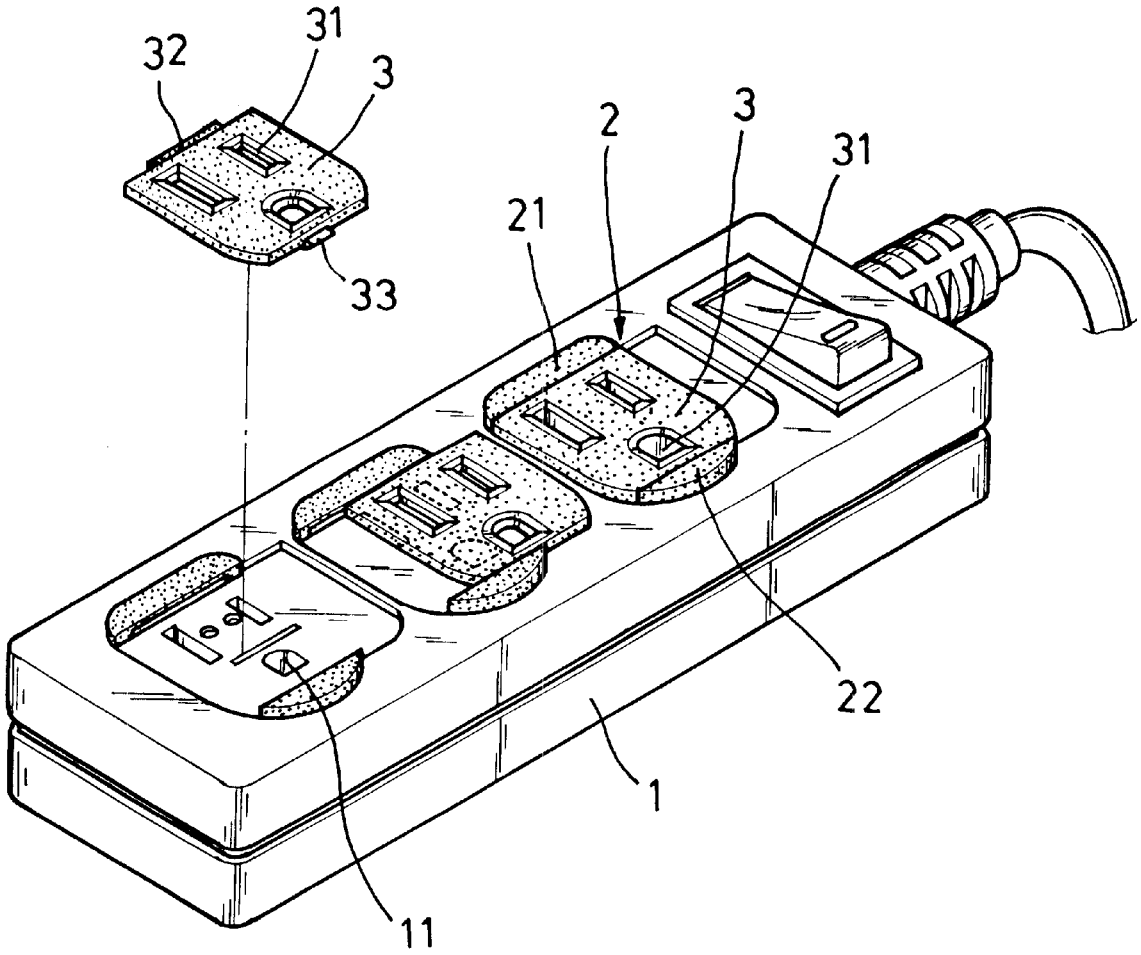
FIG. 7 is an perspective exploded view of the present invention.

First of all, referring to FIGS. 7 through 10, the safety device and dust protection for a power strip of the present invention mainly includes a housing 1 on which each outlet 2 has two opposing parallel side frames 21, 22 each of which includes a slide rail 211, 221. A hot, a neutral and a ground slots 11 are disposed between both side frames 21, 22 on the housing 1. Also, a covering piece 3 includes three slots 31 corresponding to the hot, neutral and ground slots 11.

The covering piece 3 is fitted between both side frames 21, 22 in such a way that a complete surface is formed. A larger projecting strip 32 and a smaller projecting strip 33 are arranged at the respective sides of the covering piece 3 both of which are engaged into the slide rails 211, 221 of the side frames 21, 22 for sliding motion. Moreover, the covering piece 3 includes a lateral projecting guide rail 34.

The outlet 2 of the housing 1 is provided with a guide slot 12 among the electric slots 11 which corresponds to the guide rail 34 while the guide slot 12 must be longer than the guide rail 34 for a certain displacement distance (D) of the covering piece 3 in order to cover the three electric slots 11.

Figure 8:
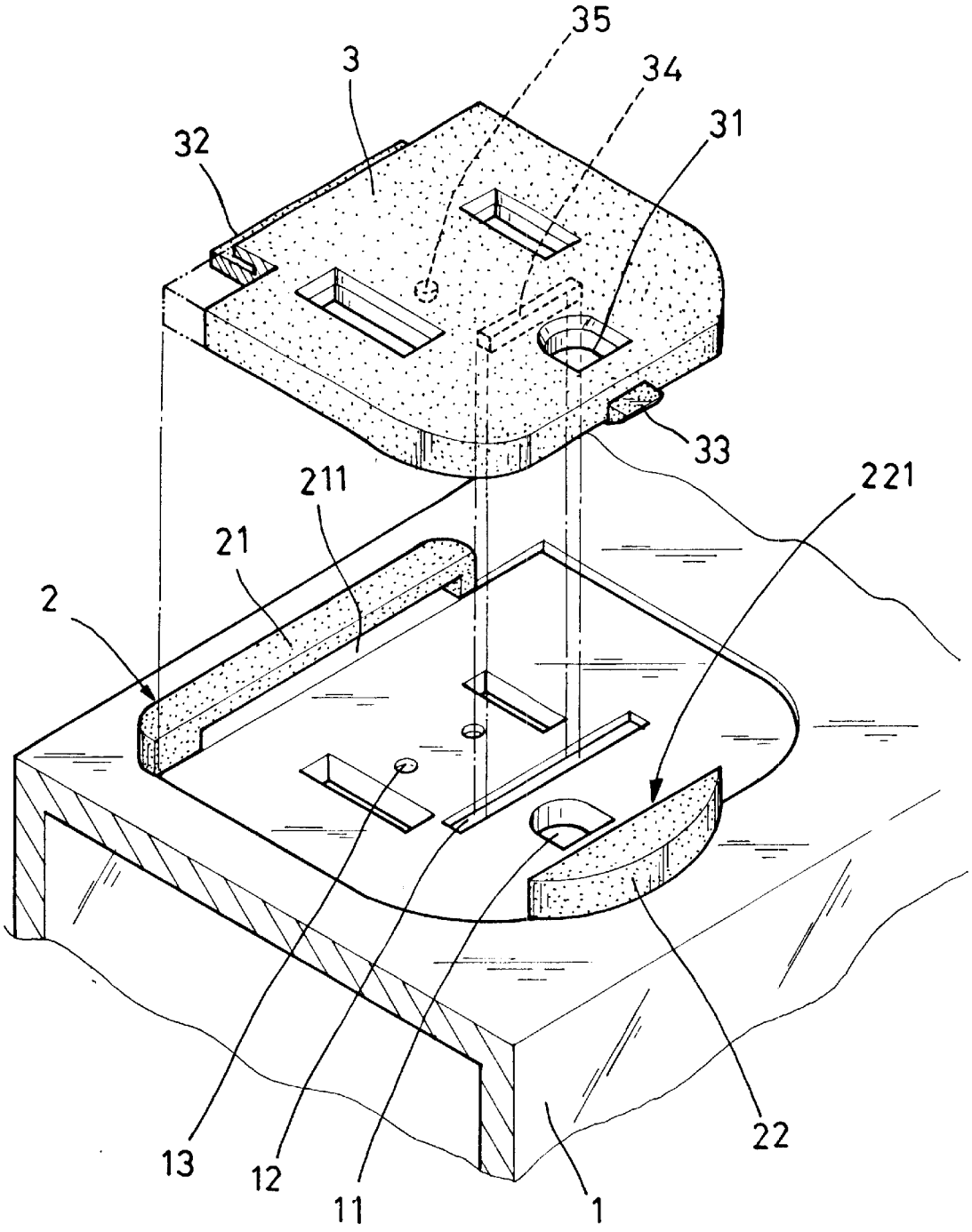
FIG. 8 is an enlarged perspective partial view of the present invention.

As shown in FIG. 8, the covering piece 3 is fitted with a projection 35 while the outlet 2 of the housing 1 has two corresponding holes 13. When the covering piece 3 is in opened or closed state, the projection 35 must be in either of the holes 13.

Figure 9:
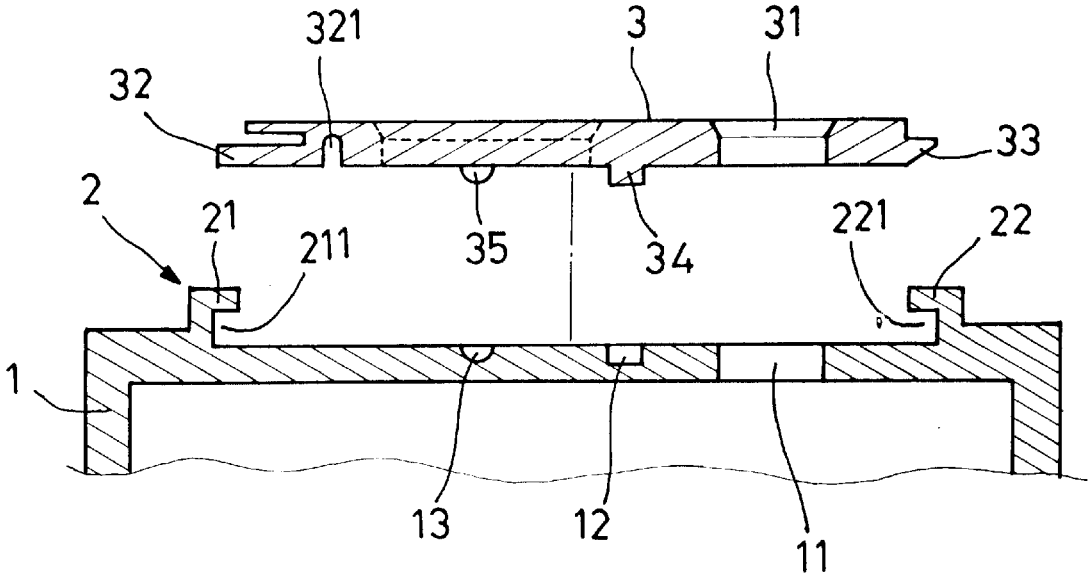
FIG. 9 is a sectional exploded view of the present invention.

As shown in FIG. 9, the covering piece 3 contains an indentation 321 at one side of the projecting strip 32 so that the covering piece 3 is elastic at the side of the projecting strip 32 in order to facilitate the engagement of the covering piece 3 into the slide rails 211, 221 of both side frames 21, 22.

Figure 10:
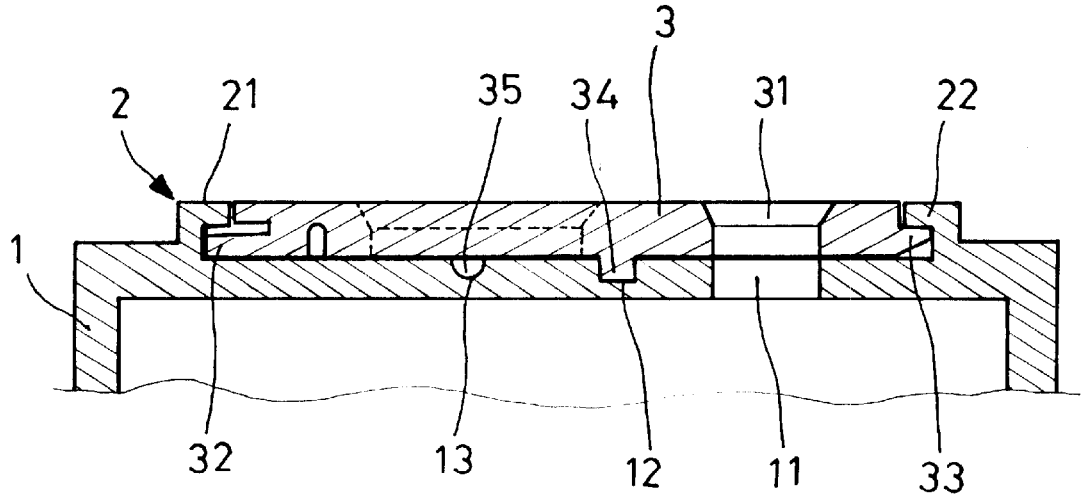
FIG. 10 is a sectional assembly view of the present invention.
Figure 11:
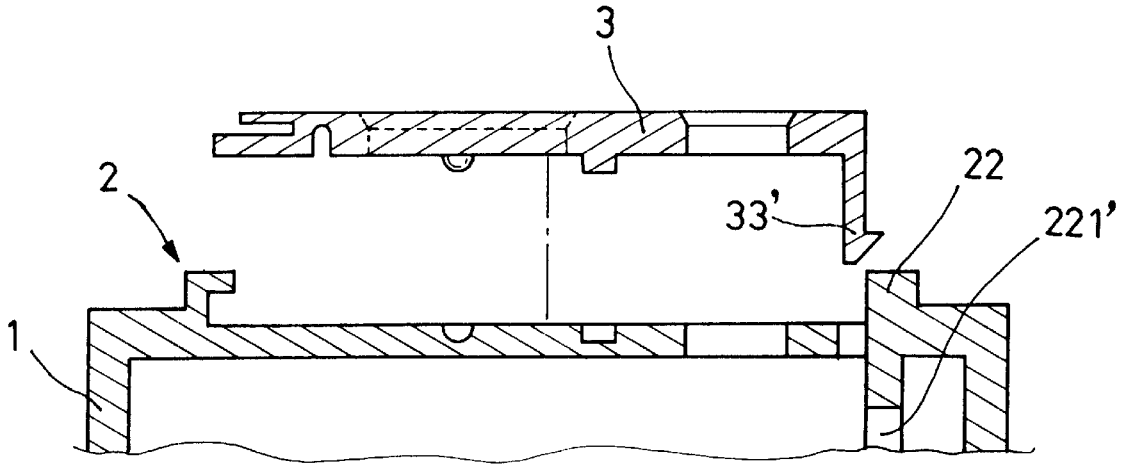
FIG. 11 is a sectional exploded view of another applicable embodiment of the covering piece of the present invention.
Figure 12:
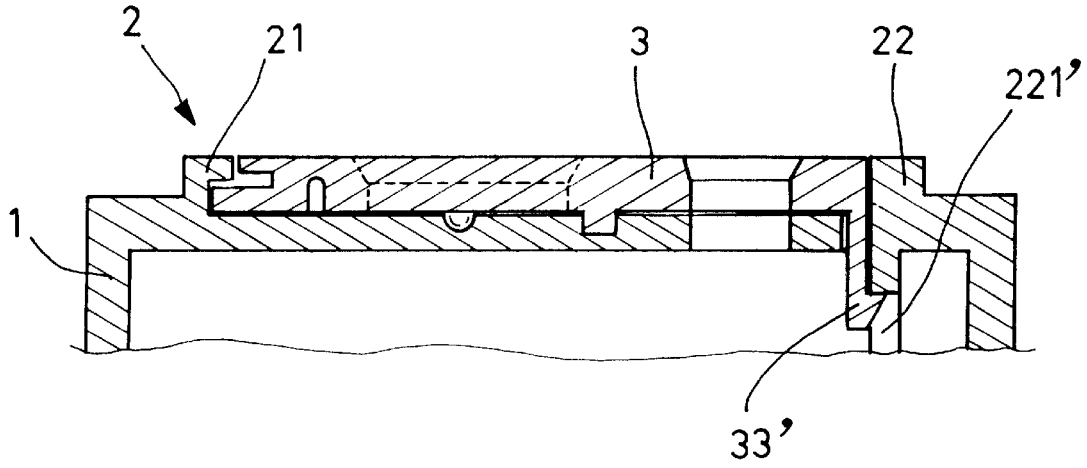
FIG. 12 is a sectional assembly view of another applicable embodiment of the covering piece of the present invention.

FIGS. 11 and 12 illustrate another applicable embodiment of the covering piece 3 of the present invention. The smaller projecting strip 33' with elasticity extends downward and is engaged into the corresponding slide rail 221' for achieving the same mounting effect of the covering piece 3 as shown in FIGS. 9 and 10.

Figure 13:
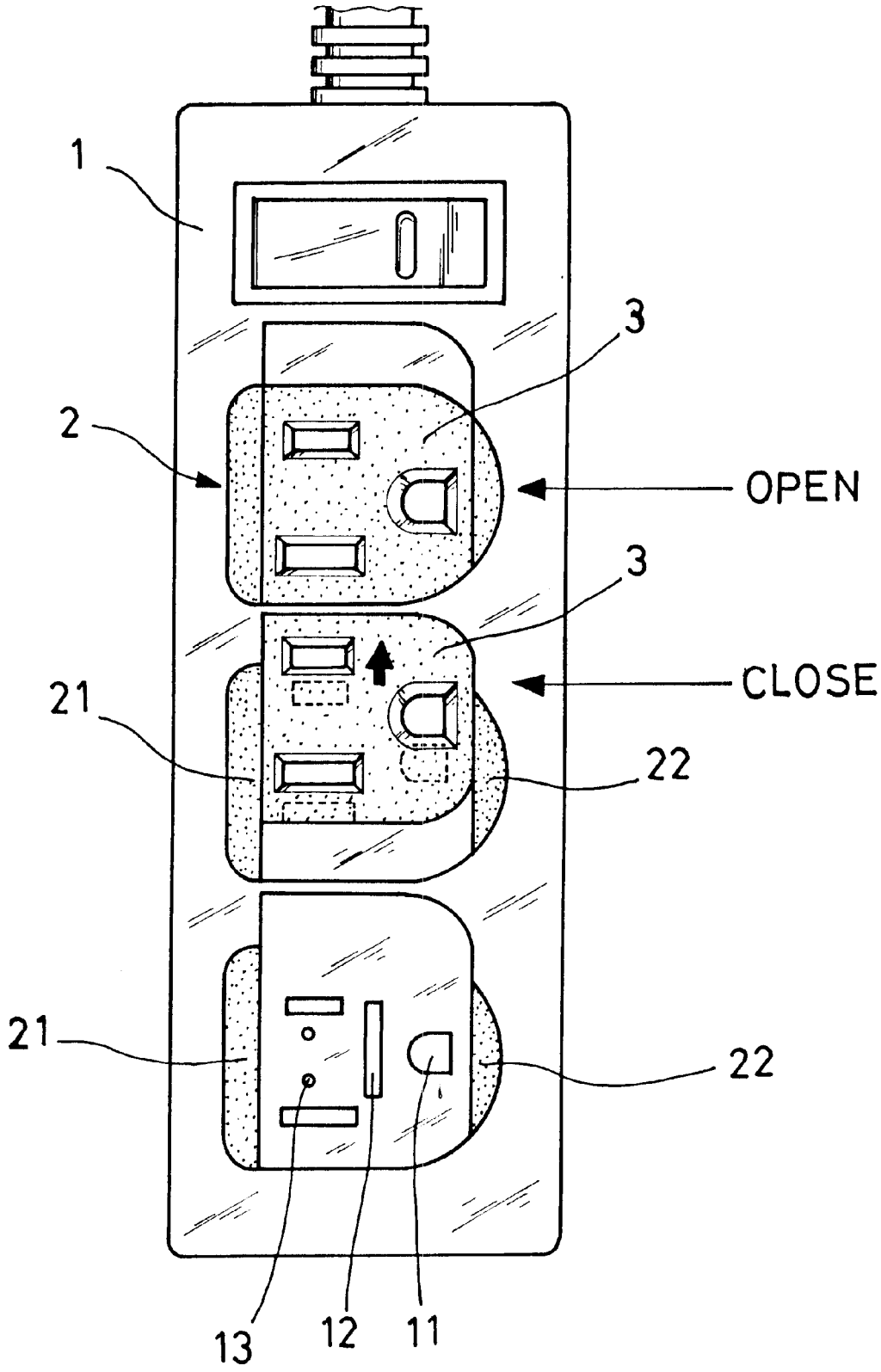
FIG. 13 is a top view of the present invention.
Figure 14:
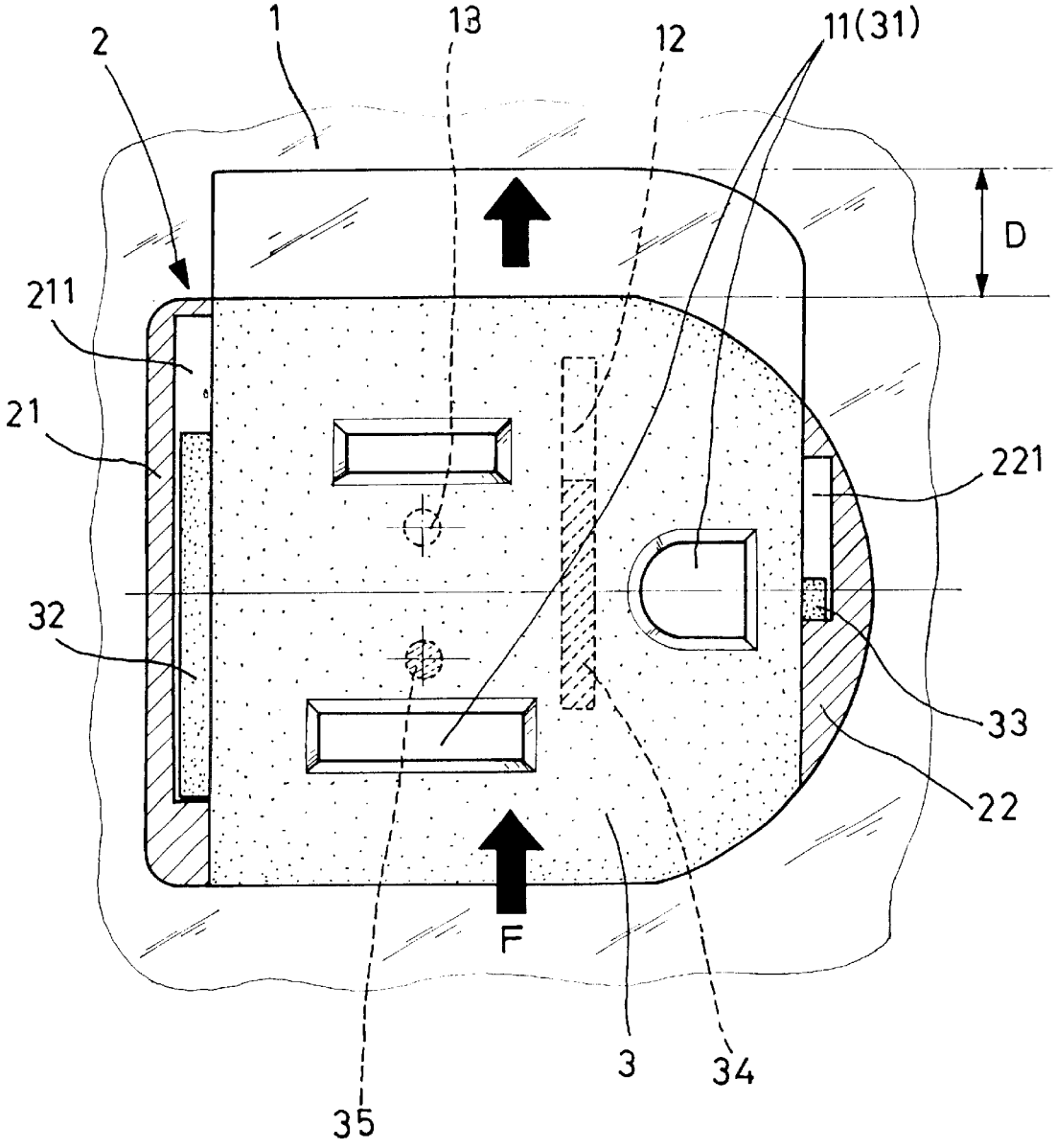
FIG. 14 is an enlarged view of the main structure of the present invention.

Referring to FIGS. 13 and 14, the covering piece 3 of the present invention together with the side frames 21, 22 creates a complete surface of the covering piece 3 when the covering piece 3 is in the open state. When the covering piece 3 is in a closed state, the covering piece 3 is shown in the middle of the outlet and has an incomplete surface. Thus, it's easily identified to avoid confusion or misuse.

The most important, as shown in FIG. 14, is that the guide rail 34 slides along the guide slot 12 for a preset distance (D) for covering the three electric slots 11 completely. Due to the guide rail 34, the covering piece 3 can always move smoothly and won't be removed even when the push direction is deviated.

Figure 15:
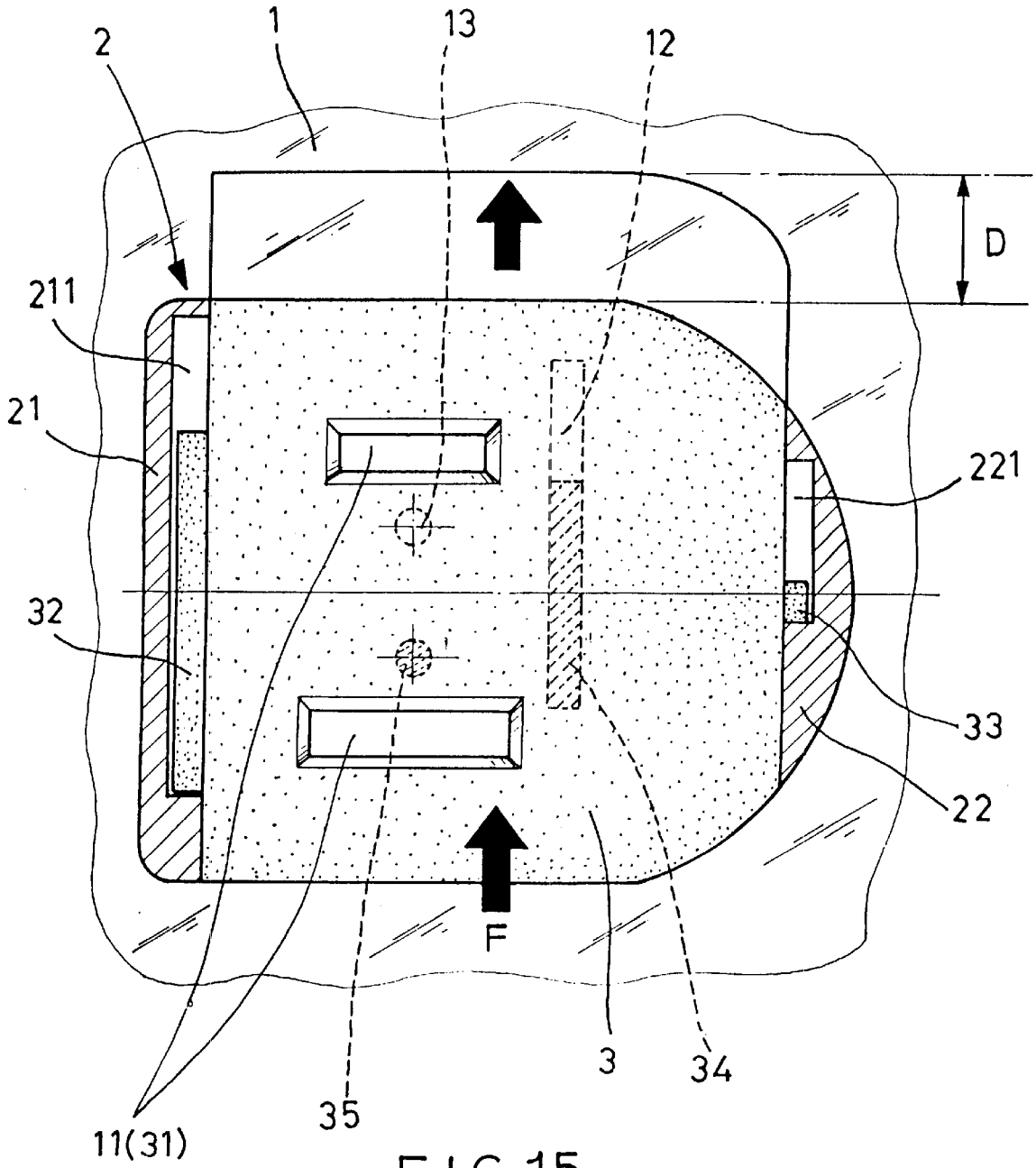
FIG. 15 is an enlarged view of the present invention with two slots.

The outlet, as shown in FIG. 15, can only have two electric slots 11 without the ground slot. Therefore, the covering piece 3 also has two slots 31 only and the protection and dustproof effect can be achieved as well.

Based on the aforementioned, the open or closed state of the outlet of the present invention can be easily identified by deciding if the surface of the outlet is complete. In addition, the three electric slots 11 can be covered at the same time so that no only can the safety effect be achieved, but also the dust protection can be fully attained in order to prolong the life of the power strip.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A safety device and dust protection for a power strip comprising:

a housing having a plurality of outlets each of which includes a pair of opposing parallel side frames, each of said side frames having a slide rail formed therein, each outlet having a plurality of electric slots for receiving plugs therein being disposed between said corresponding pair of side frames; and a plurality of covering pieces respectively associated with said plurality of outlets, each said covering piece having a plurality of slots formed therethrough corresponding to said electric slots of a corresponding outlet, said covering piece being fitted between said pair of side frames of said corresponding outlet to form a complete surface, each said covering piece having a first projecting strip and a second projecting strip respectively arranged on opposing sides thereof respectively engaged with said slide rails of said side frames for sliding motion therein, said first projecting strip being larger than said second projecting strip, each said covering piece further having a lateral projecting guide rail and a projection extending from a bottom surface thereof; and each said outlet of said housing being provided with a guide slot in an upper surface thereof adjacent said plurality of electric slots thereof in correspondence to said guide rail of a corresponding covering piece, said guide slot being longer than said guide rail by a predetermined distance corresponding to a displacement distance of said covering piece required to cover said plurality of electric slots of said outlet, said upper surface of each said outlet of said housing having two corresponding holes formed therein for receiving said projection therein when said covering piece is disposed in an open closed state.

* * * * *